US005626166A

United States Patent [19]

Hassan

[11] Patent Number: 5,626,166

[45] Date of Patent: May 6, 1997

[54] TEMPERATURE CONTROL VALVE WITHOUT MOVING PARTS

[75] Inventor: Scott E. Hassan, Middletown, R.I.

[73] Assignee: The United States of America as represented by the Secretary of the Navy, Washington, D.C.

[21] Appl. No.: 605,312

[22] Filed: Feb. 7, 1996

[51] Int. Cl.[6] ..... F15C 1/04

[52] U.S. Cl. ..... 137/828; 137/835; 137/340

[58] Field of Search ..... 137/340, 828, 137/835

[56] References Cited

U.S. PATENT DOCUMENTS

| | | | |
|---|---|---|---|
| 3,712,322 | 1/1973 | Cleary | 137/828 |
| 3,732,883 | 5/1973 | Munch | 137/828 |
| 4,196,626 | 4/1980 | Manion et al. | 137/835 |
| 4,276,895 | 7/1981 | Drzewiecki | 137/835 |

FOREIGN PATENT DOCUMENTS

| | | | |
|---|---|---|---|
| 2059651 | 12/1971 | France | 137/828 |

*Primary Examiner*—A. Michael Chambers

*Attorney, Agent, or Firm*—Michael J. McGowan; James M. Kasischke; Prithvi C. Lall

[57] ABSTRACT

The present invention relates to a temperature control valve having no moving parts. The temperature control valve has a fluid inlet and a fluid outlet. A fluidic amplifier communicates with the fluid inlet and is characterized by a first outlet port for distributing a flow of fluid to an external device such as a heat exchanger, a second outlet port in communication with the fluid outlet, and two control ports. A feedback loop is used to control the fluidic amplifier. The feedback loop has a first channel with a temperature sensitive element connected to one of the control ports and a second channel with a bias resistor for setting a desired output temperature for fluid flowing through the fluid outlet. The first and second channels create a pressure difference between the control ports of the fluidic amplifier corresponding to the desired outlet temperature.

16 Claims, 1 Drawing Sheet

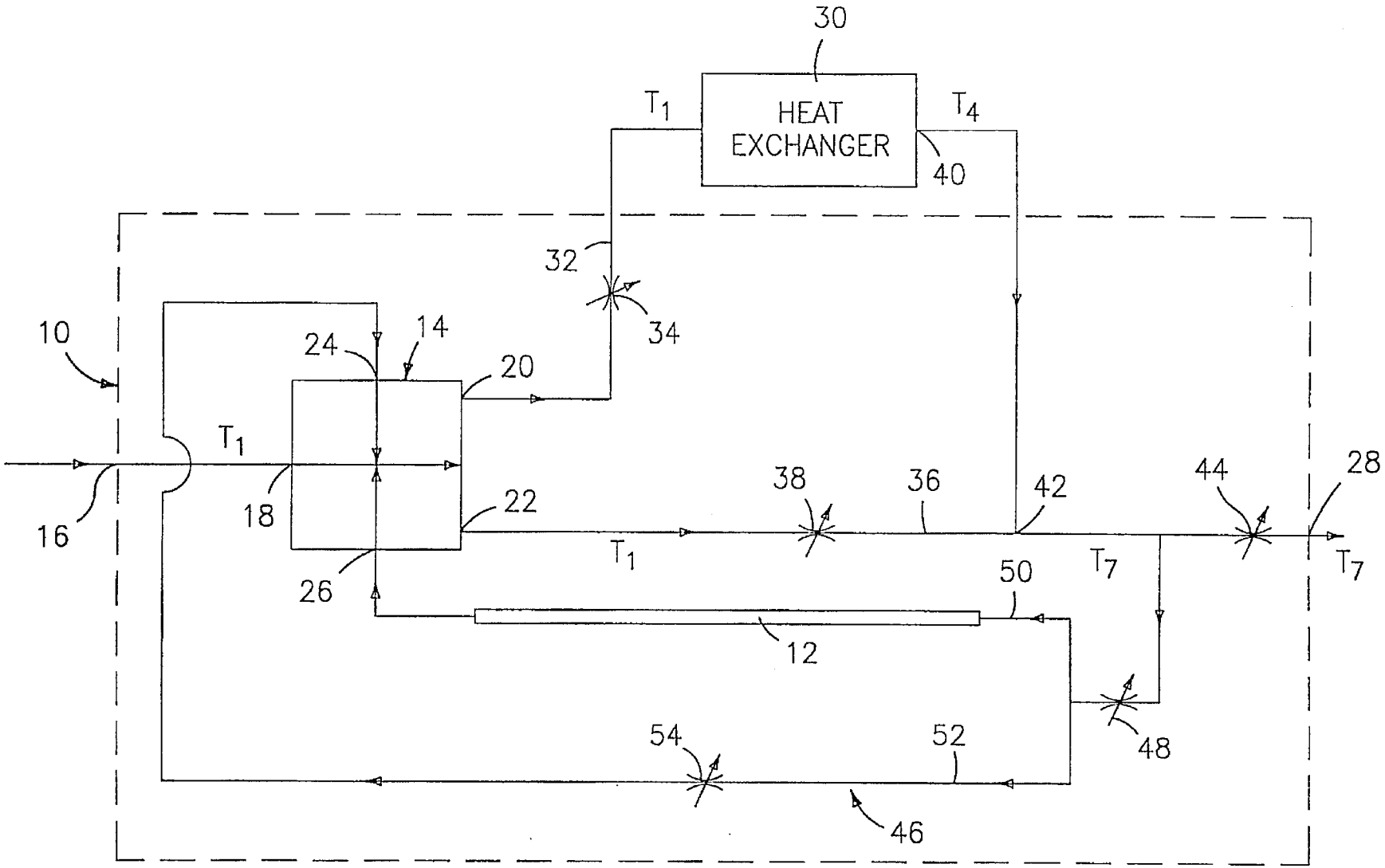
HEAT EXCHANGER
30
40
$T_4$
$T_1$
32
34
20
22
14
24
26
18
$T_1$
10
16
36
38
$T_1$
12
42
50
52
46
54
$T_7$
48
44
28
$T_7$

TEMPERATURE CONTROL VALVE WITHOUT MOVING PARTS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

1. Field of the Invention

The present invention relates to a temperature control valve that has no moving parts for regulating the temperature of a fluid, either liquid or gas, at the output of a heat exchanger.

2. Description of the Prior Art

The control of temperature in a fluid system containing a heat exchanger, e.g., radiator, boiler, furnace, is of fundamental importance for industrial, military and commercial applications. Generally, such systems rely on temperature sensitive probes, such as thermostats and thermocouples, as a means to control the motion of an actuator attached to a valve. These systems contain moving parts which are inherently prone to failure and require periodic maintenance. Additionally, these systems require an additional source of energy, e.g., electric, hydraulic, or pneumatic, to drive an actuator which controls the valve opening.

Other types of temperature control systems include the use of a volume of liquid with a high thermal expansion coefficient such as a hydrocarbon or silicone. The liquid is contained in bellows and the expansion is converted into a linear displacement to control a valve. This approach eliminates the need for an external energy source but requires a reliable seal for the liquid.

Still other types of control systems utilize fluidic circuits. U.S. Pat. Nos. 3,837,571 to Waeldner et al., U.S. Pat. No. 4,196,626 to Manion et al., U.S. Pat. No. 4,211,363 to Osheroff, and U.S. Pat. No. 4,276,895 to Drzewiecki illustrate control systems employing fluidic circuits and/or components. U.S. Pat. No. 3,631,873 to Swithenbank illustrates a fluid flow control arrangement for a heat exchanger in which first and second fluids are directed alternately to a common element such as a heat exchange surface by means of flow control devices of the fluid logic type so as to avoid the use of mechanical valves and to facilitate operation at high temperature. The above patents provide a means of temperature control with moving parts, or are not specifically designed for temperature control. None of the above provides a means of temperature control without moving parts.

Despite the existence of such technology, there remains a need for a control valve system for regulating the temperature of a fluid at the output of a heat exchanger.

SUMMARY OF THE INVENTION

Accordingly, it is an object of the present invention to provide a temperature control valve for regulating the temperature of a fluid at the output of a heat exchanger.

It is a further object of the present invention to provide a temperature control valve as above which contains no moving parts and requires no external energy source other than the working fluid.

It is still a further object of the present invention to provide a temperature control valve as above that can be used with either liquid or gas as the working fluid.

The foregoing objects are met by the temperature control valve of the present invention. The temperature control valve comprises fluidic circuit having a fluid inlet and a fluid outlet, a fluidic amplifier communicating with the fluid inlet, and a means for controlling the fluidic amplifier. The fluidic amplifier has a first outlet port for distributing a flow of fluid to an external device such as a heat exchanger, a second outlet port in communication with the fluid outlet of the control valve and two control ports. The means for controlling the fluidic amplifier comprises a feedback loop having a first channel with a temperature sensitive element and a second channel with means for setting a desired output temperature for the fluid flowing through the fluid outlet. The first and second channels are in fluid communication with the control ports and create a desired head difference between the control ports, which head difference corresponds to the desired output temperature. In a preferred embodiment of the present invention, the temperature sensitive element comprises a capillary tube.

The temperature control valve of the present invention is further characterized by a means for balancing the fluid impedance at the first and second outlet ports, a means for regulating the quantity of fluid flow through the fluid outlet, and a mixing station for mixing a flow of fluid from the external device, which fluid may be fluid exiting a heat exchanger, with a flow of fluid exiting the second outlet port.

The temperature control valve of the present invention is advantageous in a number of respects. First, it can be fabricated as a single component using standard methods. Additionally, it can be used with heat removal or heat addition in the heat exchanger section. Still further, it has no moving parts and does not require any external source of energy cooperation other than the working fluid.

Still other advantages, objects, and details of the present invention are set forth in the following detailed description and the accompanying drawing.

BRIEF DESCRIPTION OF THE DRAWINGS

The sole FIGURE is a schematic representation of the temperature control valve of the present invention.

DETAILED DESCRIPTION OF THE PREFERRED EMBODIMENT(S)

Referring now to the FIGURE, the temperature control valve 10 comprises a fluidic circuit which makes use of a capillary tube 12 as a temperature sensitive element. The capillary tube 12 can be used in this manner because the pressure drop in a capillary tube containing laminar flow is inversely proportional to temperature. Thus, as the temperature increases, the pressure drop decreases. This pressure drop can be used to control a fluidic amplifier such as amplifier 14.

As shown in the FIGURE, fluid enters at inlet 16 with a temperature $T_1$. The fluid inlet 18 of the fluidic amplifier is in communication with the inlet 16.

The fluidic amplifier 14 has first and second outlet ports 20 and 22. Additionally, it has a reference control port 24 and a temperature sensitive control port 26. Preferably, the fluidic amplifier 14 is of the beam deflection type.

In the temperature control valve system of the present invention, it is desired to control the temperature $T_7$ at a fluid outlet 28 to a specified or desired temperature. This is accomplished by controlling the amount of fluid entering the heat exchanger 30. The proportion of fluid exiting the amplifier outlet port 20 and the proportion of fluid exiting the amplifier outlet port 22 depend upon the head difference between the control ports 24 and 26. When this head difference is zero, the fluidic amplifier 14 is nulled and a volume flow range equal to half of the inlet flow rate at inlet 18 will be routed through each of the fluid outlets 20 and 22.

As shown in the figure, the outlet port 20 is in fluid communication with the heat exchanger 30 via fluid line 32. A first variable flow resistor 34 is placed in the fluid line 32. Its purpose will be discussed hereinafter. The outlet port 22, as shown in the figure, communicates with the fluid outlet 28 via the fluid line 36. A second variable flow resistor 38 is incorporated in the fluid line 36. The variable flow resistors 34 and 38 are used to balance the fluid impedance at the outlet ports 20 and 22 of the fluidic amplifier 14.

The flow of fluid passing through the outlet port 20 is at a temperature $T_1$. This fluid enters the heat exchanger 30 where heat is removed and exits at outlet 40 where its temperature has been lowered to $T_4$. The fluid passing through the outlet port 22 is mixed with the fluid exiting the heat exchanger at temperature $T_4$ at a station 42. This mixed fluid exits the valve 10 through a third variable flow resistor 44 at a temperature $T_7$.

The fluidic amplifier 14 is controlled via a feedback loop 46. The volume flow through the feedback loop 46 is controlled by a variable feedback resistor 48. In this way, the flow can be maintained laminar. As can be seen in the Figure, the feedback loop 46 has a first channel 50 and a second channel 52. The first channel 50 contains a temperature sensitive element, such as the capillary tube 12, and communicates with the temperature sensitive control port 26. The flow in the capillary tube 12 is laminar. Thus, the pressure drop for a fixed flow range and tube diameter is inversely proportional to temperature and proportional to tube length. The temperature of the fluid in the capillary tube is equal to the temperature $T_7$.

The second channel 52 of the feedback loop 46 contains a variable bias resistor 54 and is in fluid communication with the reference control port 24. The bias resistor 54 is set such that the head difference at the amplifier control ports 24 and 26 gives the desired output temperature $T_7$. The operation of the feedback loop 46 and the bias resistor 54 can be better understood from consideration of the following. If one considers the case where outlet temperature $T_7$ is perturbed to a level slightly greater than the desired outlet temperature set by the bias resistor 54, the increase in temperature results in a decrease of pressure drop across the capillary tube 12 and a subsequent increase in head at temperature sensitive control port 26. This results in a greater percentage of the flow at the inlet being routed to the heat exchanger through outlet port 20 and therefore a decrease in the temperature at outlet 28.

The temperature control valve of the present invention is versatile in that it is capable of controlling temperature when the heat exchanger adds heat to the fluid passing through the heat exchanger 30. This merely requires switching the control ports 24 and 26 leading into the fluidic amplifiers so that the first channel 50 is connected to the control port 24 and the second channel 52 is connected to the control port 26.

The variable flow resistors used in the temperature control valve of the present invention can be of the fluidic type or a simple variable area venturi. Variable resistors are useful in determining an appropriate balancing for a particular system. Once a balancing has been achieved, production units of the control valve of the present invention can use fixed resistances.

The fluidic amplifier 14 has been chosen to be proportional rather than bistable. A proportional fluidic amplifier is preferred because it allows different portions of the fluid flow $T_1$ entering the amplifier to be transferred to the outlet ports 20 and 22. Such fluidic amplifiers and their manner of operation are well known in the art. Thus, any suitable conventional proportional fluidic amplifier could be used in the temperature control valve of the present invention. Alternatively, the fluidic amplifier could be a bistable amplifier. In such an amplifier, the whole flow goes to one output. The flow would stay at that output until a desired temperature output is achieved. The entire flow would then switch to the other output.

The capillary tube 12 used in the feedback channel 50 can be an ordinary tube having a small diameter. Fluid flow through the tube, as previously mentioned, is laminar. The viscosity of the fluid changes with temperature. Therefore, the head loss in the capillary tube increases or decreases with changes in temperature. The head loss in the capillary tube can be determined by well known equations. It should be noted that the capillary tube 12 does not experience a significant change in diameter with a change in temperature.

As previously discussed, one of the advantages to the temperature control valve of the present invention is that it can be fabricated as a unit once the flow range and temperatures have been determined because impedances must be matched at the outlet ports 20 and 22 of the amplifier. It is envisioned that the control valve could be made as large or as small as the desired.

Still other advantages of the temperature control valve of the present invention is that (1) it has no moving parts; (2) it does not require any external source of energy for operation other than the working fluid; (3) it does not require any fluid other than the working fluids; and (4) it can be used with liquid or gas as the working fluid.

It is apparent that there has been provided in accordance with this invention a temperature control valve without moving parts which satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad of the appended claims.

What is claimed is:

1. A temperature control valve comprising:

a fluid inlet and a fluid outlet;

a fluidic amplifier communicating with said fluid inlet, said fluidic amplifier having a first outlet port for distributing a flow of fluid directly to an external device, a second outlet port in communication with said fluid outlet, and two control ports;

means for controlling said fluidic amplifier comprising a feedback loop having a first channel with a temperature sensitive element and a second channel with means for setting a desired output temperature for fluid flowing through said fluid outlet; and said first and second channels being in fluid communication with said control ports and creating a desired head difference between said control ports, which head difference corresponds to the desired output temperature.

2. The temperature control valve of claim 1 further comprising means for balancing said fluid impedance at said first and second outlet ports.

3. The temperature control valve of claim 1 further comprising a mixing station for mixing a flow of fluid from said external device with a flow of fluid exiting said second outlet port.

4. The temperature control valve of claim 1 further comprising means for regulating the quantity of fluid flow through said fluid outlet.

5. The temperature control valve of claim 1 wherein said temperature sensitive element comprises a capillary tube.

6. A control valve for use in a fluid system containing a heat exchanger for regulating the temperature of a fluid, said valve comprising:

a fluid inlet for receiving a flow of fluid at a first temperature;

an outlet joined to said heat exchanger for discharging fluid at a second temperature, a fluidic amplifier in communication with said fluid inlet, said fluidic amplifier having a first outlet port in direct fluid communication with said heat exchanger so that fluid at said first temperature enters said heat exchanger and a second outlet port in fluid communication with said outlet; and means for controlling the flow of fluid exiting said fluidic amplifier which is transferred to said heat exchanger through said first outlet port in order to regulate the temperature of said fluid exiting said outlet.

7. The control valve of claim 6 further comprising:

said fluidic amplifier having first and second control ports and being responsive to a pressure difference between said first and second control ports; and said control means comprising a feedback loop in communication with said first and second control ports and said outlet for controlling the pressure head across said fluidic amplifier and thereby determining said fluid flow to be transferred to said heat exchanger.

8. The control valve of claim 7 further comprising:

a mixing station joined to said second outlet port and said heat exchanger for mixing the fluids; and said feedback loop receiving a flow of mixed fluid from said mixing station.

9. The control valve of claim 8 further comprising:

said feedback loop having first and second channels;

said first channel communicating with said first control port and including a variable bias resistor for setting said second temperature; and said second channel communicating with said second control port and including a temperature sensitive element, whereby the flow of fluid through said first and second channels to said first and second control ports determines the pressure drop across said fluidic amplifier.

10. The control valve of claim 9 wherein said temperature sensitive element comprises a capillary tube.

11. The control valve of claim 8 wherein said fluid circuit further comprises:

a first resistor positioned between said first outlet port and said heat exchanger; and a second resistor positioned between said second outlet port and said mixing station, said first and second resistors balancing the fluid impedance of the output portion of said fluidic amplifier.

12. The control valve of claim 11 wherein said fluidic circuit further comprises: a third resistor positioned between said mixing station and said outlet to control the flow of fluid exiting said control valve.

13. The control valve of claim 12 wherein each of said variable resistors comprises a variable area venturi.

14. The control valve of claim 12 wherein at least one of said first resistor, said second resistor and said third resistor is a variable resistor.

15. The control valve of claim 6 wherein said fluidic amplifier comprises a proportional fluidic amplifier.

16. The control valve of claim 6 wherein said fluidic amplifier comprises a bistable fluidic amplifier.

* * * * *